US011773552B2

(12) United States Patent
Carlos Gomes De Oliveira et al.

(10) Patent No.: US 11,773,552 B2
(45) Date of Patent: Oct. 3, 2023

(54) PROCESS OF IMPLEMENTATION OF ARTIFICIAL BEACH OF RUNNING WATER FOR RECREATION

(71) Applicant: João Carlos Gomes De Oliveira, Santana de Parnaiba (BR)

(72) Inventors: João Carlos Gomes De Oliveira, Santana de Parnaíba (BR); Procópio Gomes De Oliveira Netto, Santana de Parnaíba (BR); Felipe Gomes De Oliveira, Barueri (BR); Daniel Gomes De Oliveira, Santana de Parnaíba (BR)

(73) Assignee: Joao Carlos Gomes De Oliveira, Santana de Parnaiba (BR)

( * ) Notice: Subject to any disclaimer, the term of this patent is extended or adjusted under 35 U.S.C. 154(b) by 0 days.

(21) Appl. No.: 17/937,992

(22) Filed: Oct. 4, 2022

(65) Prior Publication Data

US 2023/0175220 A1 Jun. 8, 2023

(30) Foreign Application Priority Data

Oct. 7, 2021 (BR) ..... 1020210201479

(51) Int. Cl.
*E02B 3/04* (2006.01)
*E02B 15/04* (2006.01)

(52) U.S. Cl.
CPC ..... *E02B 3/04* (2013.01); *E02B 15/04* (2013.01)

(58) Field of Classification Search
CPC ..... E02B 3/04; E02B 15/04; A63G 31/007
See application file for complete search history.

(56) References Cited

U.S. PATENT DOCUMENTS

| | | | |
|---|---|---|---|
| 5,928,608 | A | 7/1999 | Levesque et al. |
| 8,465,651 | B2 | 6/2013 | Fischmann et al. |
| 9,470,008 | B2 | 10/2016 | Fischmann |
| 10,597,316 | B2 | 3/2020 | Gomes De Oliveira et al. |
| 11,053,649 | B2 | 7/2021 | Gomes De Oliveira et al. |

FOREIGN PATENT DOCUMENTS

| | | | |
|---|---|---|---|
| BR | 9813714 | A | 10/2000 |
| BR | 0202350 | A | 6/2004 |
| BR | 102012032567 | A2 | 9/2014 |
| BR | 112016002808 | A2 | 9/2017 |
| BR | 112013024625 | A2 | 2/2018 |
| BR | 112016008529 | B1 | 4/2022 |
| JP | H05309207 | A | 11/1993 |
| JP | H08155465 | A | 6/1996 |
| WO | 2009054717 | A1 | 4/2009 |

*Primary Examiner* — Sean D Andrish
(74) *Attorney, Agent, or Firm* — BROWDY AND NEIMARK, P.L.L.C.

(57) ABSTRACT

Implementation of an excavated artificial beach (1) of running water, using water (9) captured from an external water body (2), of any origin, which is treated by a flotation/decanting system (20), the water (6) of the excavated artificial beach (1) being returned to the external water body (2).

15 Claims, 9 Drawing Sheets

PROCESS OF IMPLEMENTATION OF ARTIFICIAL BEACH OF RUNNING WATER FOR RECREATION

TECHNICAL FIELD

This descriptive report refers to an application for an elaborate invention patent, for the process of implementation of artificial beaches, with running water, fresh or salty, exclusively for recreational use and contemplation.

STATE OF TECHNIQUE

Humanity has always had a need leisure options and has always sought situations in which he can relax while open air.

Among the most common are the sea baths, rivers, lakes, swimming pools, etc., where the population can enjoy leisure at low cost or at zero cost.

Swimming pools, both public and private, are not able to reach a large portion of the population, due to its size reduced. In addition, the construction of large swimming pool, it demands very high resources, which make its construction unfeasible.

In addition, human activity pollutes seawater, lakes, of rivers, streams, etc., making it impossible to use them for leisure "on site", making it impossible to use water in a different place.

The implementation of large areas for bathing runs into several problems, such as the executive method, obtaining water in large quantity, at low cost; treatment of this water; system of permanent disinfection, so as to allow its suitability for bathing; and so on.

Several solutions have presented themselves for the deployment of large areas for balneability, however, do not solve all the existing problems and have high costs for deployment and operation.

Patent application NO. BR112016008529-9 teaches the treatment of existing or excavated large bodies of water, and the maintenance of its balneability, using flocculation system within the body of water, with the decanting of solids, suction device of this material, for its filtration and return to the main body, system suction on the water surface, for degreasing, with return from water to the main body, and small part disinfection system of the body of water, so as to maintain its balneability.

The suction equipment, both from the bottom of the water body, as of the surface, are commonly known in conventional swimming pools. In large bodies of water, such equipment consumes a large amount of electricity, in addition to their high implementation and maintenance cost, combined with the physical space that with a risk to users, as they operate within the area suitability for bathing. Because it works with water filtration, it is not possible to use sand at the bottom, as they would clog the filters. In addition, it is recirculation of water, which also prevents the use of water sand at the bottom, which would be sucked by the suction devices (bottom and surface).

Patent application NO. BR102012032567-5 teaches only the disinfection of a large body of water, with the addition of chemicals themselves, making no mention of the implantation of the body of water per itself.

Patent application NO. BR112013024625-1 teaches a system treatment and maintenance of water bodies for recreational use, low density of people, with the lining of the bottom of a body existing water with waterproof membrane, suction of decanted sediments at the bottom of the body of water; water filtration sucked by the suction system, from a small portion of the body water; return of water already filtered to the body of water; injection of disinfectants, such as ozone, biguanide products, algicides and antibactericidal agents such as copper products, iron salt, phosois, chlorine compounds, peroxides, phenolic compounds, iodophors, quaternary animas (ammonium polyquaternaries) in general, such as benzalkyl chloride and s-trianaine, peracetic acid, compounds athalogen-based compounds, bromine-based compounds, compounds based on chlorine and its combinations; control and coordination of the steps through the receipt and processing of the information collected, for the activation of processes (e.g. by computer, and may sensors, etc.).

That patent application BR112013024625-1 does not novelty in relation to a conventional swimming pool and for being of greatsize, existing equipment consumes a large amount of electricity, in addition to its high cost of implementation and maintenance, combined with the physical space it occupies, with a risk to users, for having mobile suction equipment. For working with water filtration, it is not possible to use sand at the bottom of the space reserved for bathers, as they would clog the filters. In addition to the that, the recirculation of water is foreseen, which is sucked in by the suction system, treated in the filter system and returning to the point of origin.

Patent application NO. BR112016002808-2 teaches implantation of a floating lake, within a larger body of water, with the installation of walls, for the formation of the smaller lake within the larger body of water; application of flocculants (described in claim 6); mobile suction system at the bottom of the water body, for component suction in the black color of the background; water filtration sucked by the suction system, and it is not necessary to filter the whole body of water; return of water sucked and filtered to the body water; coordination system that controls all stages, being that the coordination system is laid down and configured to receive information on water quality parameters, process the information, and activate the means of application of products and/or activate the operation of the suction device and/or filtration system; bottom of the water body coated with non-permeable materials, such as, the bottom is a flexible material selected from among the group consisting of rubbers, plastics, teflon, low density polyethylene, high density polyethylene, polypropylene, nylon, polystyrene, polycarbonate, polyethylene, fibres, fibreboard, wood, polyamides, PVC membranes, fabrics, composite fabrics, geomembranes, acrylics, and their combinations;

That patent application BR 112016002808-2, does not presents novelty in relation to a conventional pool inserted in a larger body of water, moreover, brings complications in the sense that it is necessary to deploy walls to "surround" a space for balneability, and anchoring and structures are required to stability, which increases its implementation, in addition to using a suction and filtration system, which prevents the use of sand in the bottom of the space. In addition, the recirculation of water is foreseen, which is "surrounded space", is treated in the filter system and returns to the to the "fenced space".

Invention patent no. P19813714-0 teaches only the clarification of swimming pools, through the application of perforese chlorine according to the need for disinfection.

Patent application No. JPH08155465-5 teaches only one reagent dissolution device, which is installed in a reagent dissolution system recirculation of pool water, and the circulated water is filtered by a filtration device, returning to the pool. The above-mentioned solid reagent (chlorination agent) is dissolved and mixed in water recirculated for the disinfection of the swimming pool.

This system is used in swimming pools, with waterproof walls and without the sand cover, since it also uses filters, to treat the water of that pool under recirculation, which is incompatible with the use of sand at the bottom of the water body to be treaty. In addition, there is a need for recirculation of water, which it takes place in a closed loop, with the water coming out of the pool, passing filtering process and returning to the pool.

Patent application No. JP05309207 teaches a system of clarification for water in a pond, where water is captured in body water, passes through a first flocculation tank and sedimentation of solids, and the water is sent to the lagoon, and the said water from the lagoon is recirculated, passing through filtration and clarification system, returning the water to the lagoon and not to the water body of origin.

Because it uses a first stage of sedimentation of and, later, a step of filters in your system of recirculation of water, this system cannot be used in with a background in sand. In addition, there is no return of water from the pond to the source water body (from where the water was captured), or that is, the water in the pond remains stationary, only receiving filtering and clarification treatment, within the system of recirculation, in closed circuit.

The patent for invention no. P10202350-4, authored by the inventor teaches the implantation of a lake for balneability, with capture of water from an external source; its external treatment, in treatment by the flotation system; continuous disinfection of the lake, in order to allow the balneability and return of water to the body of external water, without treatment.

This system presented some technical disadvantages in the implementation, such as: deformation of the sand surface, due to neutral pressure of the groundwater; the need to occupy large area attached to the lake, for the installation of the treatment station by flotation (tanks, pipes, equipment, etc.); impossibility water treatment by decanting, as the treatment station provides only and only flotation treatment; impossibility the design and joint and/or alternating use of two water treatment systems (flotation and decanting), for economy in the treatment process depending on the amount of attendants; decanting dirt from bathers and the area adjacent to the beach with consequent contamination of the sand; difficulty removal of dirt and fat on the surface of the water as a function of the large dimensions of water minor; water extraction problem treated with residual floating dirt in the receiving body of water, the which may harm aquatic biota; and so on.

OBJECTIVES AND ADVANTAGES OF INVENTION

So, thinking in providing the improvement of the environment and providing greater number of balneable areas for the population, the applicant, as expert in the water treatment system, including more than 90 patents granted in the sector, in addition to having extensive experience in implementation of artificial beaches, being a pioneer in Brazil and in the world in this segment, developed a low-cost system for implementation of balneable artificial beaches, with running water, to exclusive use of recreation.

The deployment of artificial leisure beach, requires certain costs construction, as maintenance, and the process developed by the applicant minimizes such costs, making his more viable and affordable deployment and maintenance.

The present case provides for the deployment of an artificial beach of running water, of any size, from the excavation of the lake, conformation of the surroundings, aiming at the leisure of users, capture of water from an external water body, treatment of captured water, maintenance of water balneability, return of water to the body of origin.

In the vicinity of an external water body (sea, bay, river, stream, lake and etc.), an artificial lake of size, desired shape and depth, and the material removed from the soil, will be deposed on the shores of that lake, setting up a embankment or mound of land adjacent to the lake, and such a mound of earth will be coated with natural sand, forming sand dunes, similar to the existing dunes in points of the Brazilian coast.

The use of material removed from the ground for the excavation of the lake and setting up dunes, rather than transporting it and discarding it in boots-off, significantly reduces the costs of its deployment.

On these dunes covered with natural sand, they may be leisure equipment, such as slides, slides, waterfalls, zipline, lookouts, descent ramps, etc., which adds urban attractions for the site.

For the waterproofing of the artificial beach bottom, it is foreseen to use of vinyl or plastic blanket.

Underneath the vinyl or plastic blanket is provided for the installation of a simple system of metal or plastic tips, which are connected to pumps for suction of water and gases, providing a lowering of the water table to ensure that there is no deformations and damage to the vinyl or plastic blanket may occur as a result of the neutral pressure of the water table or the emanation of gases.

On the bottom waterproofing is provided a layer of natural sand, identical to that deposited upon the mounds of land for the dune conformation, which will conform the bottom and the beach throughout artificial beach area, in addition to landscape configuration similar to a natural paradise beach.

It may also be added to natural sand, a portion of plastic artificial sand, or phosphorescent resin, which absorb the photons by day and emit these photons at night, without using energy electrical, causing lighting effect and brightness similar to that occurs on natural beaches with the presence of a kind of phytoplankton which, when stirred by the currents of water, emit light shimmering, that at night shines in the sand and waters, providing a night urban attraction.

For the filling of the artificial beach, raw water is captured from external source, of any nature (river, sea, bay, lake, reservoir, etc), including polluted water, which is treated through a continuous and flexible treatment by flotation and/or decanting, depending on the required flow depending on the amount of regulars on the artificial beach, generating improvement in maintenance and operational economy, as it does not have the need for a system of suction, suction, filters or recirculation of treated water on the beach as in conventional pool systems.

The adoption of the continuous and flexible treatment channel, in replacement treatment station, optimizes the treatment of captured water; generates physical space savings; equipment economy (pipes, pumps, appliances, etc.).

Another advantage of this process is not to use filters for the treatment of the internal water of the artificial beach, since the water is treated before it enters the artificial beach and does not return for further treatment, being returned to the water body of origin.

Another advantage of this process is the elimination of suction and/or suction devices, whether arranged at the bottom of the beach, either arranged on the surface, since the internal water of the artificial beach does not require further treatment.

Another advantage of the present case is the disinfection of the artificial beach water, be promoted by means of water and air injections sodium hypochlorite at various points on the sandy bottom of the artificial beach, promoting oxidation, resuspension and flotation of the dirt eventually decanted inside the artificial beach, this dirt, coming from bathers and the surroundings of the beach itself artificial.

This injection of water and air with sodium hypochlorite, carried out in several points at the bottom of the artificial beach, combined with the background covered with sand, creates a new appeal to users, which will have the existence of jets hydromassage scans and also creates the "boiling" effect, as if was a natural spring, where at the bottom of sand "springs" water natural.

The disinfection of artificial beach water is supplemented with the injection of water and air jets with sodium hypochlorite, in several points on the edge of the water minor, for the oxidation of any pollutants and targeting of this resuspended and flotation pollution until the exit of the artificial beach.

These side jets also have recreational function, as they work as hydromassage to bathers.

Another advantage of the present case is the installation ea floating and stationary dredging wheel at the exit of the beach for the removal of resuspended and fused pollutants, in order to that do not return to the main water body and will harm your biota.

This floating and stationary dredging wheel, for scraping resuspended and fused pollutants, consumes less energy, in comparison to the surface suction and/or suction device, as well as, does not interfere with the use of the beach by bathers, a stationary in a specific location, far from the place of recreation, unlike the bottom suction device and/or mobile surface aspiration, which requires displacement throughout the surface of the water mirror and cannot be triggered with the presence of bathers, as it carries a risk of sucking them and any drowning.

To assist in the removal of this resuspended and flotated pollution until the artificial beach exit is provided a scraper system floating surface that can be triggered manually or through electric winches for scraping and quick targeting and pollution to the dredging wheel.

At the exit of the artificial beach, the installation of a cistern for the retention of sand, so that there is no loss of sand and provide evaporation of residual sodium hypochlorite through aeser system to expedite this process, so that the water to be returned to the main water body does not contain hypochlorite of sodium and may impair your biota.

For the convenience of users, it is planned to install a small lake at the entrance of the artificial beach, with system of washer and showers, with the injection of water and air jets with hypochlorite sodium, and the water used in this small lake does not mix with the treated water of the main artificial beach and provides disinfection of users and removal of dirt that harm the quality of artificial beach water.

Another advantage of this process is that there is no waste of water, one that all water captured for use, is returned to after the water body of origin, since it is an artificial beach running water, in addition to the fact that the returned water does not contain residual sodium hypochlorite, and is also in better condition (depolluted) than the water captured (polluted), generating a gain invaluable environmental policy.

In this way, the combination of the steps that make up this process and the intrinsic characteristics of this invention, allows a better overall result, considering the technical aspects, economic and environmental issues, compared to the state of the art.

SUMMARY DESCRIPTION OF THE INVENTION

In view of the inconveniences mentioned above, verified in the state of the art, on the deployment of artificial beach for recreational use and contemplative, and in order to meet the related objectives, was developed implementation of an artificial beach of running water, for the use of leisure and contemplation, without the use of filters, without the use of bottom suction and/or suction devices and/or surface in the lake, without the need for recirculation of lake water and with the possibility of using water from any source, polluted.

Excavation of the artificial beach is foreseen, in shape, depth and size, and the deposition of the material taken from the ground, on the shores and surroundings of that artificial beach, setting up one or more mounds of land adjacent to the artificial beach, and such mounds of land will be coated with sand formation of one or more sand dunes, similar to the dunes existing in points of the Brazilian coast.

On these dunes covered with natural sand, it is foreseen to installation of leisure equipment, such as slides, waterfalls, zipline, lookouts, descent ramps, etc., which adds attractive to the site.

For the waterproofing of the artificial beach bottom, it is foreseen to use of vinyl or plastic blanket, and underneath this waterproofing is foreseen the installation of a system of tips metal or plastic, which are connected to pumps for suction of water and gases, providing a lowering of the water table, to ensure that there are no deformations and damage to the waterproofing, depending on the neutral pressure of the water table or by emanation of gases.

On this background waterproofing is provided a layer of natural sand, identical to that deposited on the mounds of earth in dune conformation, which will conform the bottom and the beach throughout artificial beach area, in addition to landscape configuration similar to a natural paradise beach.

It may also be added to natural sand, a portion of plastic artificial sand or phosphorescent resin, which absorb the photons by day and emit these photons at night, without using energy electrical, causing lighting effect and brightness similar to that occurs on natural beaches with the presence of a kind of phytoplankton which, when stirred by the currents of water, emit light shimmering, that at night shines in the sand and waters, providing a night urban attraction.

For the filling of the artificial beach is provided the water catchment external source, of any kind (river, sea, bay, lake, reservoir, etc.), including polluted water, which is treated through continuous and flexible flotation and/or decanting treatment channel, depending on the required flow depending on the amount of artificial beach goers, and the amount of water on the artificial beach is equalized through a water outlet, that returns the water to the water body of origin, without the need for additional treatment.

Water captured from the external water body before being released on the artificial beach, is treated through a continuous treatment channel and flexible by flotation/decanting, equipped with an internal septum, for the division of that channel, enabling the operation of the system in normal or reduced scale, closing one of the subchannels of the septum, depending on the amount of water required on the artificial beach, in by virtue of the number of regulars and for possible maintenance in the channel and in the systems that are part of the treatment.

The disinfection of artificial beach water is promoted by means of water and air injections with sodium hypochlorite at various points in the sandy bottom of that artificial beach, promoting oxidation, resuspension and flotation of the dirt eventually decanted within the artificial beach, this dirt, coming from bathers and the surroundings of the own artificial beach.

The disinfection of artificial beach water is supplemented with the injection of water and air jets with sodium hypochlorite, in several points on the edge of the artificial beach, for the oxidation of any pollutants and targeting this resuspended pollution to the outflow of the artificial beach. These side jets also have recreational function, because they function as hydromassage to bathers.

In addition to the cleaning of the artificial beach, it is foreseen, in the the installation of an artificial beach, the installation of a floating and stationary dredging, for the removal of pollutants suspended and fused, so that they are not thrown into the body main water supply.

To assist in directing this resuspended pollution and flotated until the exit of the artificial beach is provided a scraper system floating surface, which can be triggered manually or through electric winches, for scraping and quick targeting and effective use of this pollution resuspended and wettered to the wheel of floating and stationary dredging.

At the exit of the artificial beach, after the floating dredging wheel and stationary, the installation of a tank for the retention of sand, so as to avoid loss of sand and provide the evaporation of residual sodium hypochlorite, so that the water to be returned to the main water body does not contain hypochlorite of sodium and may harm your biota.

For the convenience of users, it is planned to install a small lake at the entrance of the artificial beach, with system of washer and showers, with the injection of water and air jets with hypochlorite sodium, providing disinfection of users and removal of dirt that may impair the water quality of the artificial beach, the water used in this small lake is not mixture with treated water from the artificial beach.

DESCRIPTION OF FIGURES

To complement this description, in order to gain a better understanding of the characteristics of the present case and in accordance with a preferential practical implementation of it, the description is accompanied by a set of drawings, where, in an exemplified manner, though not limited, if it represented the following.

DETAILED DESCRIPTION OF THE OBJECT

Figure 1:
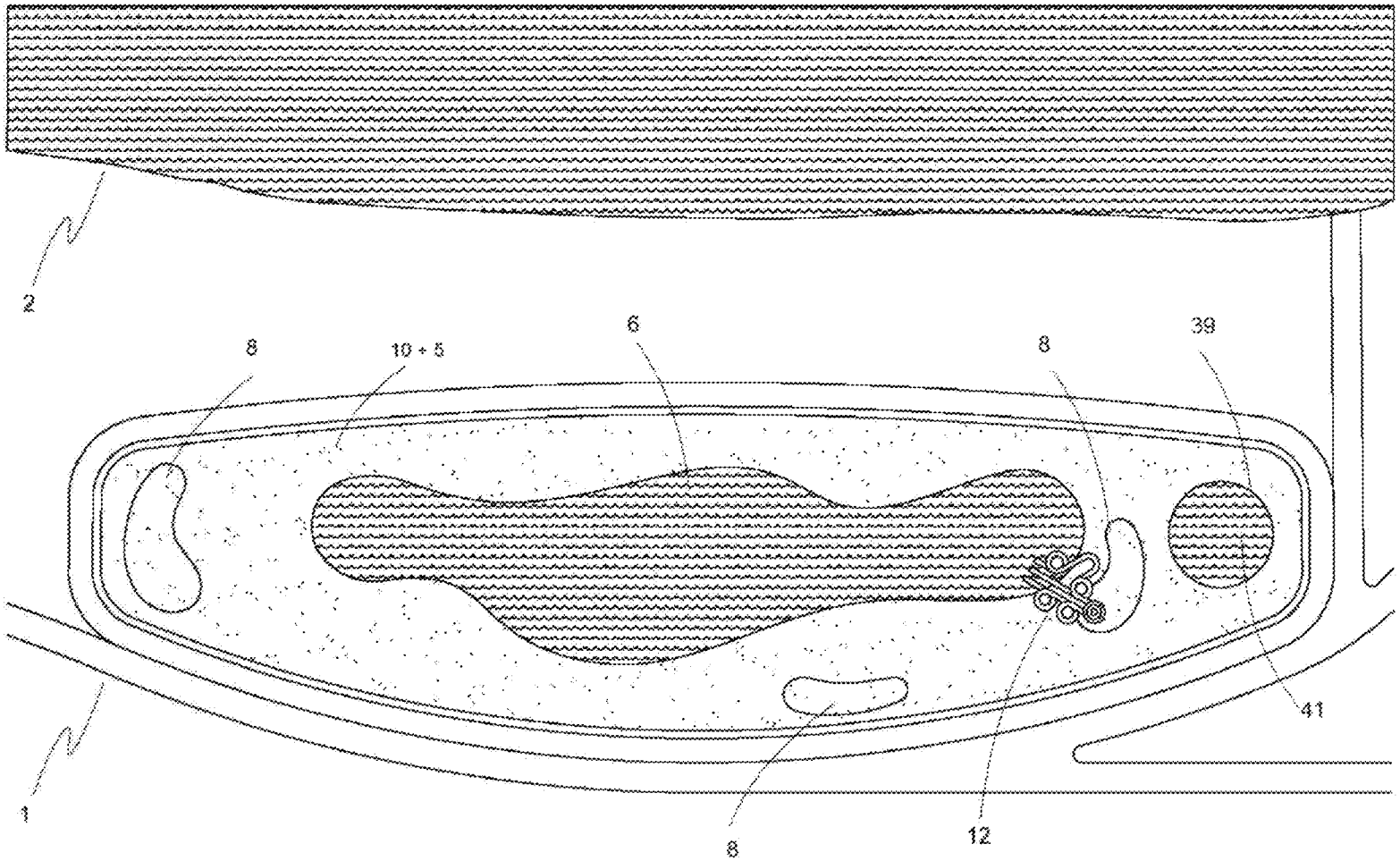
FIG. 1 shows an aerial view of the whole set.
Figure 2:
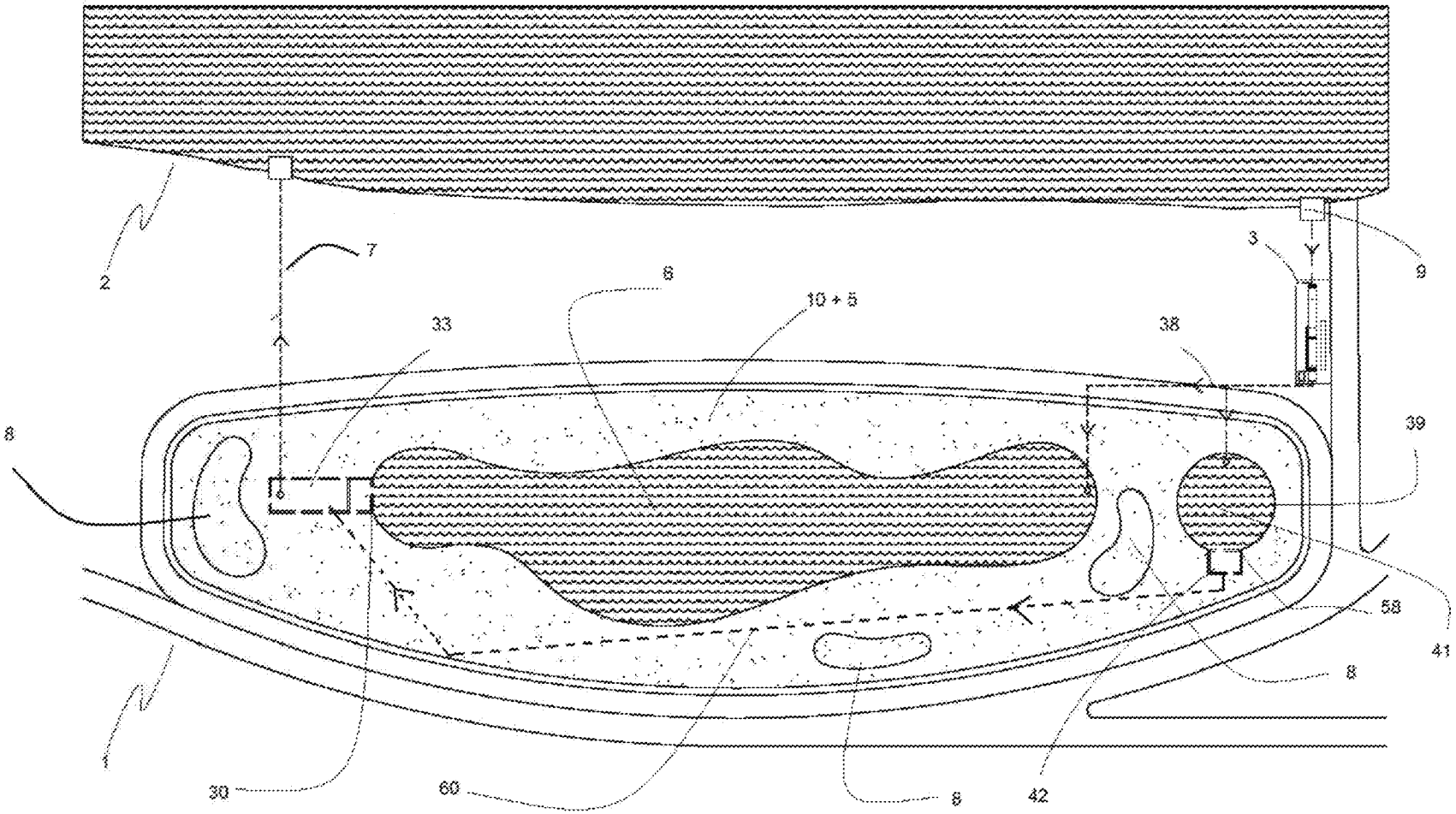
FIG. 2 shows an aerial view of the assembly with the input and water outlet.
Figure 3:
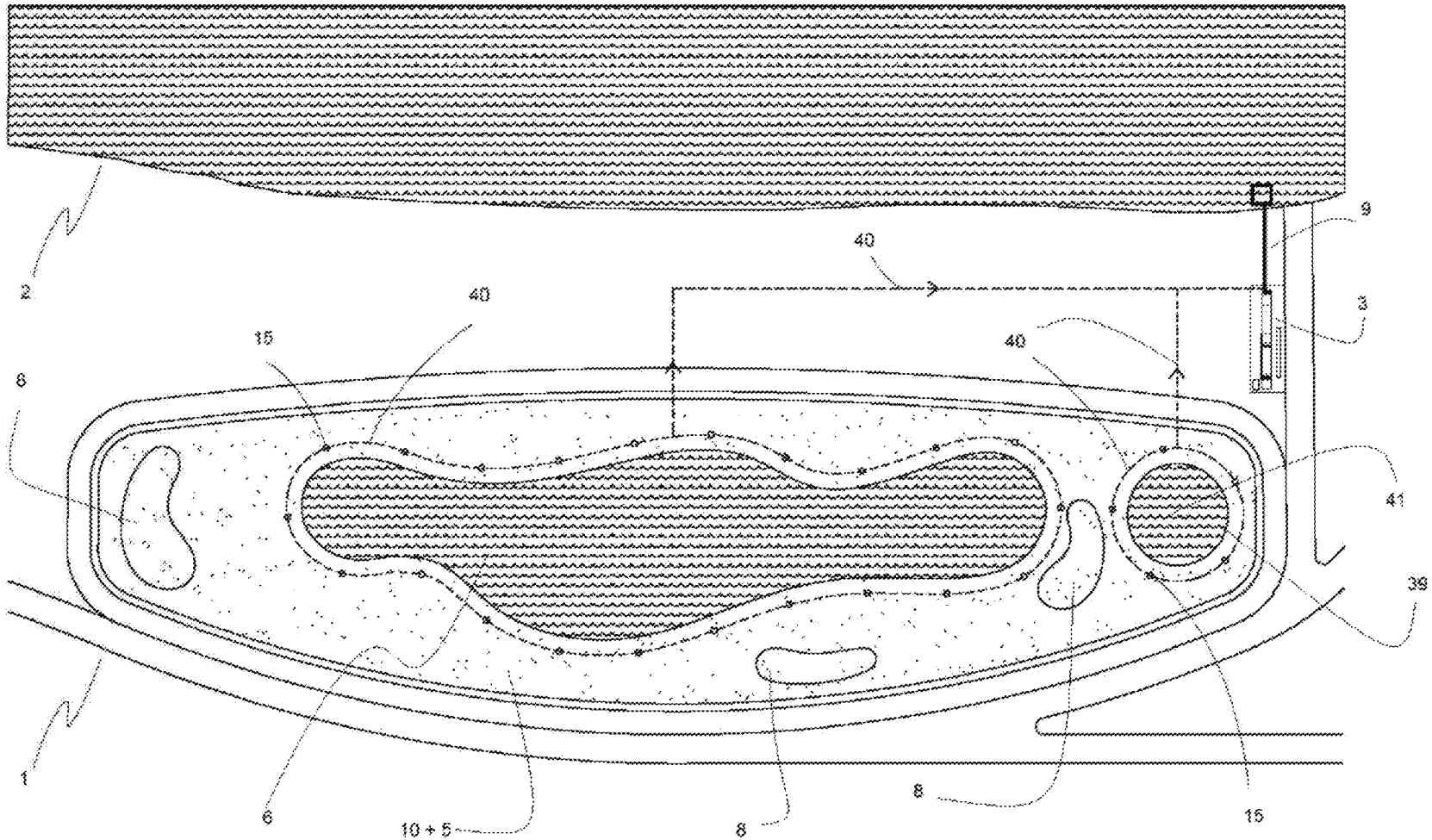
FIG. 3 shows an aerial view of the assembly with the suction of the water or gases from the water table.
Figure 4:
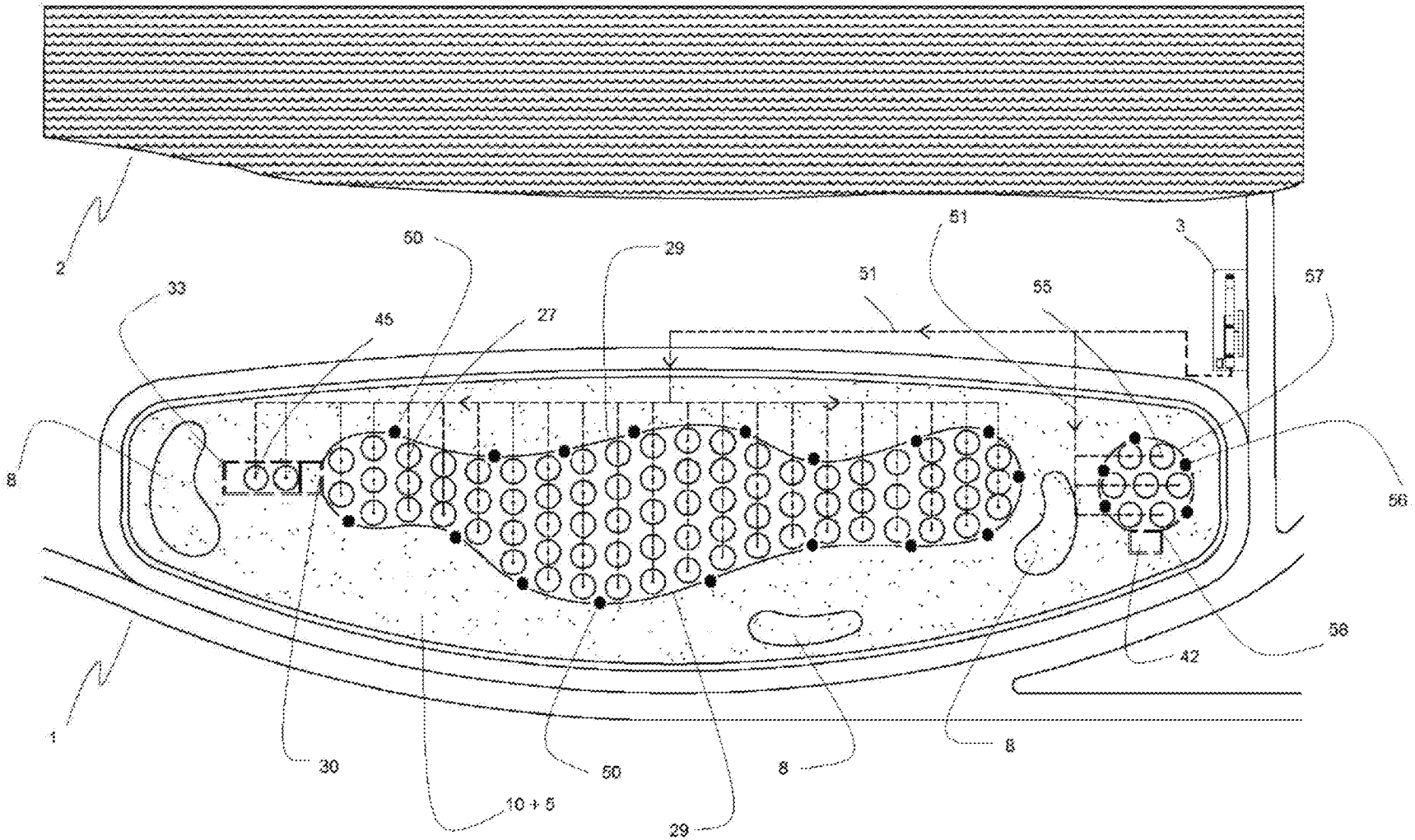
FIG. 4 shows an aerial view of the set with the aeters background.
Figure 5:
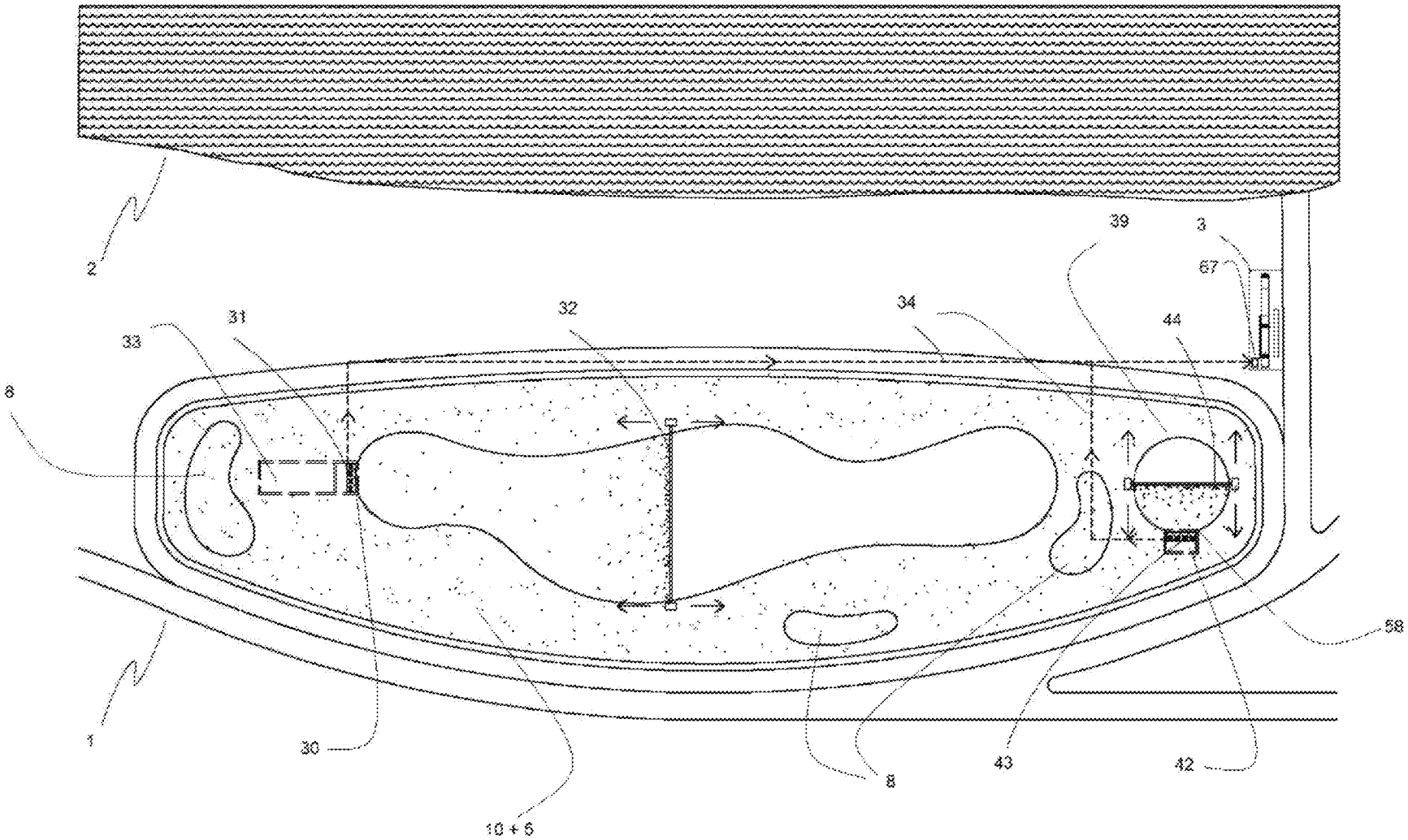
FIG. 5 shows an aerial view of the set with the scrapers slomy and slot piping.
Figure 6:
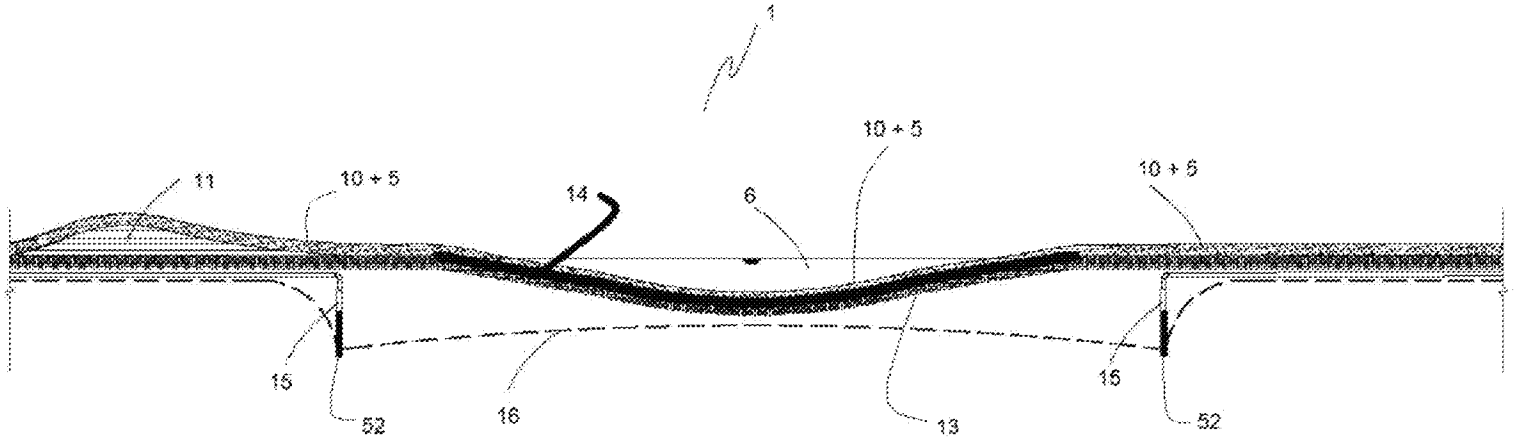
FIG. 6 shows a side cut of the lake, including the water table suction.
Figure 7:
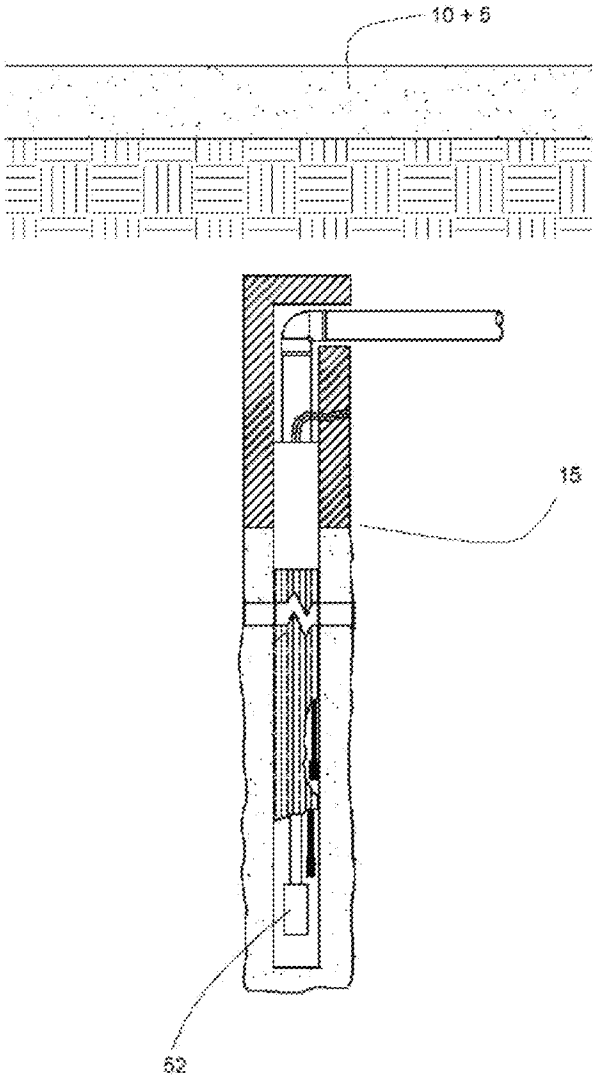
FIG. 7 shows the installation of the suction tip under the lake.
Figure 8:
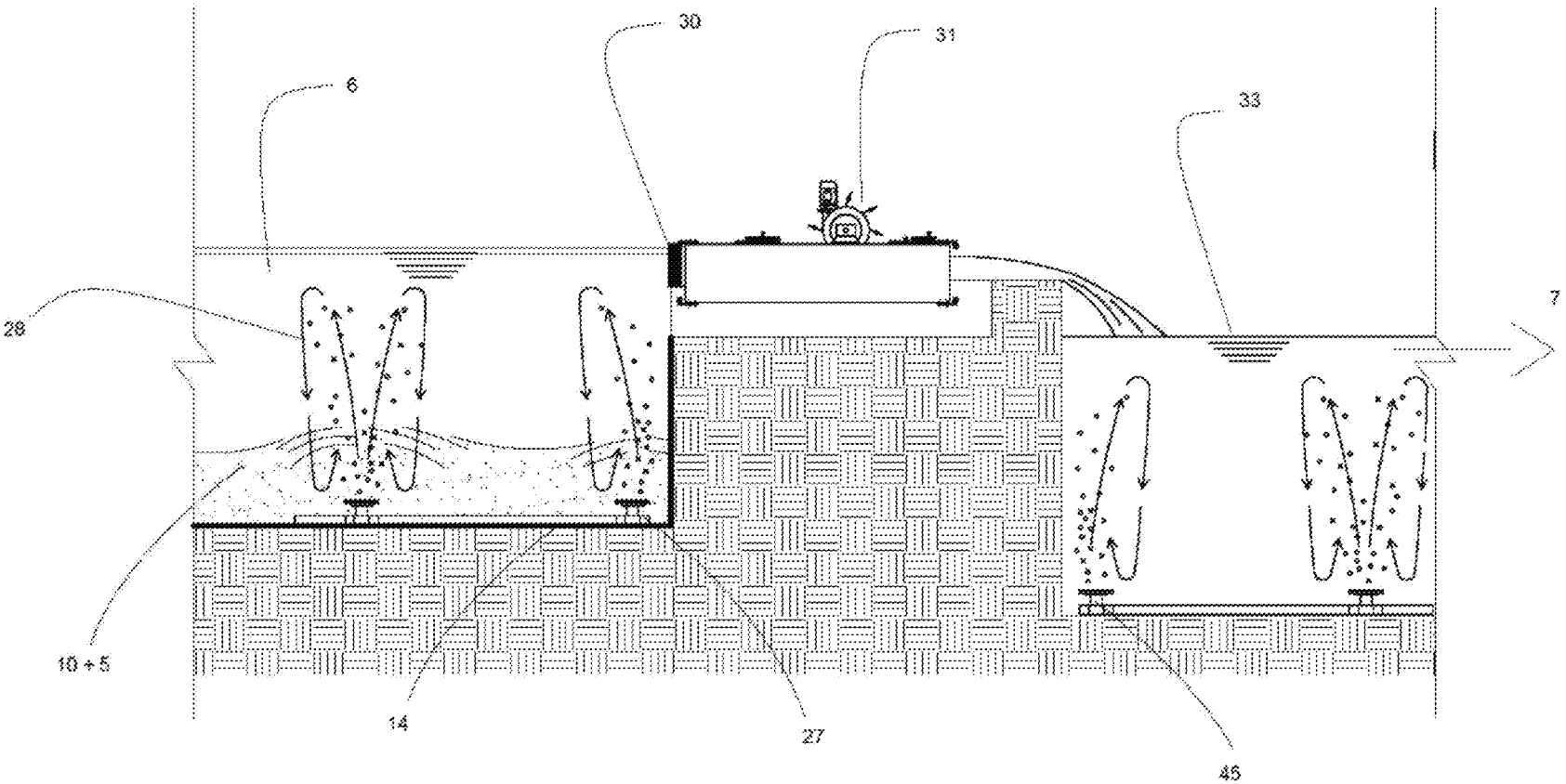
FIG. 8 shows the bottom aerators, providing "hydromassage" and resuspension of the bottom dirt, the collection of clove and the lake water extravasor.
Figure 9:
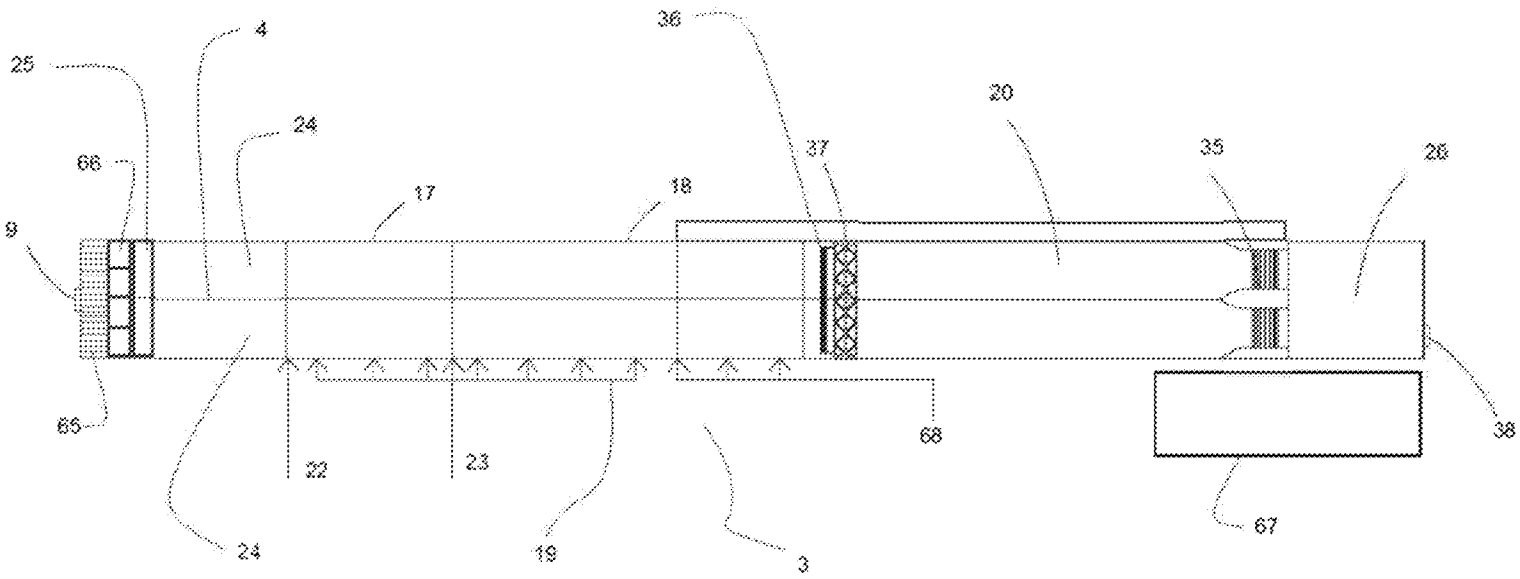
FIG. 9 shows the continuous, linear and flexible channel of treatment of water that feeds the lake.

As illustrated by the listed above is provided for in this patent application for invention, a "BEACH IMPLANTATION PROCESS ARTIFICIAL RUNNING WATER FOR RECREATION", more precisely, it is a process of implementing an excavated artificial beach (1) for recreational use and using water captured (9) from an external water body (2), treated in a linear, continuous and flexible treatment channel (3) by flotation/decanting (20), equipped with an internal longitudinal septum (4), for the division of that linear, continuous and flexible treatment channel (3), with permanent disinfection system, without the use of filters, without the use of suction and/or suction devices at the bottom and excavated artificial beach (1) surface, without the need to recirculation of the water from the lake, and the water (6) from the artificial beach returns (7) to the external water body (2), from where it was captured (9), with the possibility of using water from any source, including polluted, and the water used on that excavated artificial beach (1) is constantly returned to the external water body (2) origin, in a better condition than was captured (9).

Excavation of the excavated artificial beach (1) is planned in desired shape, depth and size, and the material removed from the ground is deposited on the shores and surroundings of that excavated artificial beach (1), configuring one or more hills (8) adjacent to the excavated artificial beach (1), and such hills (8) are coated with natural sand (10), forming one or more dunes (11) of sand, similar to the existing dunes in of the Brazilian coast.

On these dunes (11) covered with natural sand (10), it is installation of leisure equipment (12), such as, slides, waterfalls, zip line, lookouts, descent ramps, etc, which adds attractions to the site.

The bottom (13) of the excavated artificial beach (1) excavated is waterproofed (14) with the use of vinyl or plastic blanket.

Under the waterproofing (14) with vinyl blanket or the installation of a system of metal tips is provided for, which are connected to pumps (52) for suction of water and gases, providing a lowering of the water table (16), to ensure that there are no deformations and damage to waterproofing (14) with a vinyl or plastic blanket, depending on the neutral pressure of the water table (16).

Water from the water table (16), captured by the metal tips or plastic tips (15), is transported (40) up stream of the linear, continuous and flexible treatment channel (3), mixing the water from the external water body (2), for treatment and use for filling the excavated artificial beach (1).

Over this waterproofing (14) with vinyl blanket or plastic of the bottom (13) of the excavated artificial beach (1) is expected to placement of a layer of natural sand (10), identical to that deposited on the hills (8) of dune-forming land (11), which will the bottom (13) and the beach itself, throughout the area of the excavated artificial beach (1), in addition to providing configuration landscape similar to a natural paradisiacal beach.

As a constructive alternative, it can be added to the sand (10), a portion of plastic artificial sand or resin phosphorescent (5), which absorb the day photons and emit these photons at night, without the use of electricity, causing the effect of lighting and brightness similar to what occurs on natural beaches, with the presence of a kind of phytoplankton which, when agitated by the streams, emit shimmering light, which at night shines in the sand and in the waters.

For filling (38) of excavated artificial beach (1) and small lake (39), the capture (9) of a crude water of a external water body (2), of any nature (river, sea, bay, lagoon, reservoir, etc.), including polluted water, which is treated through linear, continuous and flexible treatment channel (3) by flotation and/or where the captured water (9) passes through a grid (65) of retention, followed by a sand and silts retention box (66), both installed upstream of the linear treatment channel, flexible (3) by flotation and/or decanting, and the grid (65) waste retention retains floating and submerged solid waste and the sand and silt sand retention box (66) retains the sand and silts contained in the flow of the captured water (9), and the said captured water (9), follows the linear, continuous and flexible treatment channel (3) by flotation and/or decanting, for treatment with the steps of coagulation (17) and flocculation (18), with a mixture of coagulant (22) and flocculant (23), through aeration (19) and microaeration (68) with concentrated oxygen, and these aeration (19) and microaeration (68) are performed through membrane concentrator device zeolite, as the oxidation of organic matter facilitates the treatment and generates economy in operation, followed by flotation or decanting (20), removal of flotation sludge or decanted sludge to the sludge deposit (67), disinfection (26) and passage of water already treated and disinfected to the excavated artificial beach (1).

In the above mentioned the linear, continuous and flexible treatment channel (3) is installation of at least one internal longitudinal septum (4), centrally or decentralised in relation to the channel linear, continuous and flexible treatment (3), and this longitudinal septum (4) is mounted along the internal area of the said continuous, linear and flexible channel (3), in order to make up at least two parallel linear subchannels (24), allowing those parallel linear subchannels (24) are used for actuations such as a parallel subchannel (24) operating with the flotation (20) and the other parallel subchannel (24) operate with flotation (20), or a parallel subchannel (24) remain closed and the other parallel subchannel (24) remain operating, both by flotation (20), decanting (20), depending on the required flow rate, depending on the number of regulars on the excavated artificial beach (1), allowing even more refinement in the choice of processes, ensuring even more economy and for possible maintenance in the channel and in the systems that are part of the treatment.

At the entrance of each of the parallel subchannels (24) the installation of independent floodgates (25), for control individualized flow rate and individual use of each subchannel parallel (24).

The said division of the linear, continuous and flexible (3) by flotation and decanting (20) into two subchannels parallel (24) by the internal longitudinal septum (4), allows the use of a parallel subchannel (24) for water treatment, while the other parallel subchannel (24) does not operate, saving energy from equipment, so that they do not operate in an idle manner, as in situations of low flow of treatment, due to the amount of regulars of the said excavated artificial beach (1) and for any maintenance in the channel and in the systems that are part of the treatment.

The flotation sludge, formed by the treatment of water by the canal continuous and flexible treatment (3) by flotation and/or decanting, is removed from the linear, continuous and flexible treatment channel (3), by the wheel dredging (35), aided by a surface scraper (36), and is released in the sludge deposit (67) and can be recycled and reused in the most diverse activities.

Sludge decanted at the bottom of the flexible linear treatment channel (3), by flotation and/or decanting, is removed from the background of that linear, continuous and flexible treatment channel (3) by a suction system (37), being launched into the sludge deposit (67), can be recycled and reused in the most diverse activities.

At the output of the linear, continuous and flexible treatment channel (3), the treated water goes through a disinfection process (26), supplying the lake of the excavated artificial beach (1) and the small lake (39).

Permanent disinfection of water (6) from excavated artificial beach (1) is promoted by means of background aerators (27), which promotes injections water and air with sodium hypochlorite at various points in the bottom (13) sandy beach of the excavated artificial beach (1), promoting oxidation, resuspension and flotation of the dirt eventually decanted within the excavated artificial beach (1), this dirt, coming from bathers and around the excavated artificial beach (1) itself.

The water and air injection system by bottom aerators (27) from points at the bottom (13) of the excavated artificial beach (1), also provides an attraction to the user of the excavated artificial beach (1), such as hydromassage jets (28) and/or generates the "nascent" effect, as is found naturally in boiling, where, at the bottom of sand, "natural water springs".

Permanent disinfection of excavated artificial beach (1) water (6) is complemented by injection by injectors (50) of water and air jets with sodium hypochlorite, at various points in the edge (29) of the excavated artificial beach (1), for the oxidation of any pollutants and targeting this resuspended pollution to the exit (30) of excavated artificial beach (1). These side jets, launched by the injectors (50), also have a recreational function, as they function as hydromassage (28) to bathers.

The water used for the permanent disinfection system is (51) downstream of the linear, flexible and continuous treatment channel (3) by flotation and/or decanting and upstream of the excavated artificial beach (1) water, which dispenses with the use of clean water from an external source, generating more savings in the system and not interfering with water (6) quality of the excavated artificial beach (1), to be used by bathers.

Resuspended pollution on the surface of water (6) of the excavated artificial beach (1) is directed to the exit (30) of the excavated artificial beach (1), through water and air injectors (50), existing at the edge of the (29) of the excavated artificial beach (1), and this pollution suspended, is captured through a wheel of floating and stationary dredging (31), installed at the exit (30) of the excavated artificial excavated beach (1), preventing these resuspended pollutants from returning to the body external water (2).

To assist in directing this resuspended pollution until the exit (30) of the excavated artificial beach (1) a system is provided for floating surface scraper (32), which can be triggered manually or through electric winches, for scraping and rapid and effective targeting of this existing pollution on the surface from the water (6) from the excavated artificial beach (1), to the dredging wheel floating and stationary (31).

Still at the exit (30) of the excavated artificial beach (1) and after the wheel floating and stationary dredging (31), the installation of cistern (33) for sand retention and evaporation of hypochlorite sodium sodium, cistern (33) is also endorsed with aerators of (45) so as not to lose sand and to provide the evaporation of residual sodium hypochlorite, so that the water to be returned (7) to the external water body (2), does not contain hypochlorite sodium and may harm your biota.

Resuspended pollution removed by wheel of floating and stationary dredging (31), at the exit (30), of the excavated artificial beach (1), is transported by pipe (34), to the sludge deposit (67), the continuous and flexible treatment channel (3), for its removal and reuse in various activities.

For the convenience of users, it is planned to install a small lake (39) at the entrance of the excavated artificial beach (1), with foot washer and shower system, with disinfection system permanent by injecting water and air jets with hypochlorite of through bottom aerators (55), and through injectors (56), installed at several points on the edge (57) of the small lake (39), providing permanent disinfection of water (41) and removal dirt that may impair the quality of water (41), the small lake (39), and the water (41) used in the in this small lake (39), after passing through the cistern (42), it is transported (60) and disposed of directly in the existing cistern (33) at the exit (30) of the excavated artificial beach (1), not mixing with the treated water for filling (38) the excavated artificial beach (1).

In the small lake (39), also installed wheel of floating and stationary dredging (43), which removes suspended pollution (41), being aided by a surface scraper (44).

Resuspended pollution removed by floating and stationary dredging wheel (43), at exit (58), of the small lake (39), is transported by pipe (34), to the sludge deposit (67), the linear, continuous and flexible treatment channel (3), for its removal and reuse in various activities.

In the same way as on the excavated artificial beach (1), under the small lake (39) the installation of a small system is envisaged metal tips or plastic tips (15), which are connected to the pumps (52) for suction of water and gases, providing a lowering of the water from the water table (16), and the water of the water table (16), captured by the system of metal tips or plastic tips (15), it is transported (40) to the entrance of the linear treatment channel, continuous and flexible (3), mixing the water from the body (2), for treatment and use for filling the excavated artificial beach (1) and small lake (39).

Within the basic construction described above, it is pleaded that the this process of implantation of an excavated artificial beach (1) running water for recreational and contemplative use, using water (9) from an external water body (2), treated in a water channel linear, continuous and flexible treatment (3) by flotoation/decanting (20), without the use of filters, without the need for water recirculation, without the use of suction and/or suction devices at the bottom or on the surface of the excavated artificial beach (1), and the said water (6) of excavated artificial beach (1) and water (41) of small lake (39), return (7) to the external water body (2), from where it was (9), with the possibility of using water from any other origin and nature, including polluted, and the water used in the excavated artificial beach (1) is constantly returned (7) to the external water body (2), in better condition than was captured (9), subject to this patent, may be modified by the subject of the construction, sizing, materials, functional configurations, procedure stages and parameters, without escaping the scope of patent protection.

The invention claimed is:

1. A process of implementation of artificial water beach current for recreation, intended for the implementation of an excavated artificial beach (1) running water for recreational use and using water captured (9) from an external water body (2) of any origin, which will be treated without need of filters and without need for recirculation of water (6) originating from the excavated artificial beach (1), characterized by excavating of the excavated artificial beach (1), with depositing of material removed from ground on shores and surroundings of the artificial excavated beach (1), configuring one or more hills (8) of land adjacent to the excavated artificial beach (1), coating the one or more hills (8) of land with natural sand (10), forming one or more dunes (11) of the natural sand (10), with waterproofing (14) of a bottom (13) of the excavated artificial beach (1), and under the aforementioned waterproofing (14), installing of metal tips or plastic tips (15), which are connected to pumps (52) for suction of water and gases from a water table (16), and placing a layer of natural sand over the waterproofing (14) of the bottom (13) of the excavated artificial beach (1) filled with raw water captured (9) from the external water body (2), and capturing the raw water from the external water body (2), before filling the excavated artificial beach (1) being launched in an input continuous and flexible linear treatment channel (3) by at least one of flotation system and decanting (20), the continuous and flexible linear treatment channel (3) having a longitudinal septum (4), which divides the continuous and flexible linear treatment channel (3) in parallel subchannels (24), and the raw water captured (9) from the external water body (2) after at least one of treatment flotation and decanting (20) and disinfection (26), being launched in the excavated artificial beach (1), with permanent disinfection of the excavated artificial beach (1) being provided, by means of injections of water or air with chlorine, through bottom aerators (27), in various bottom (13) points waterproofed (14) and covered with natural sand (10) and through injectors (50), installed at various points in an edge (29) of the excavated artificial beach (1), and a floating scraper system (32) being installed upstream of an exit (30) point from the excavated artificial beach (1) and a wheel of floating and stationary dredging (31), for dredging resuspended pollution existing on a surface of artificial beach water, and at the exit (30) point from the excavated artificial beach (1) and after the wheel of floating and stationary dredging (31), a cistern (33) is installed for retention of sand carried from the excavated artificial beach (1) and for evaporation of residual chlorine, and water (6) from the excavated artificial beach (1), after passing through the cistern (33), is returned (7) to the external water body (2) of origin.

2. The process of implementation of artificial water beach recreational chain according to claim 1, characterized by adding artificial sand plastic or phosphorescent resin (5), together with the layer of natural sand (10), around the excavated artificial beach (1), in the dunes (11) and on the waterproofing (14) of the bottom (13) of the excavated artificial beach (1).

3. The process of implementation of artificial water beach recreational chain according to claim 1, characterized by the raw water captured (9) at the external water body (2), being launched into an inlet channel, treated through the continuous and flexible linear treatment channel (3) flotation or decanting (20), capturing the raw water from the external water body (2), where the captured raw water (9) passes through a grid (65) garbage retention, followed by a sand retention box and silts (66), both installed upstream of the continuous and flexible linear treatment channel (3) by flotation or decanting, and the captured water (9), follows the continuous and flexible linear treatment channel (3), where the treatment is received with coagulation (17) and flocculation (18), with mixture of coagulant (22) and flocculant (23) through aeration (19) and microaeration (68), with concentrated oxygen, and the aeration (19) and microaeration (68) are performed through a device zeolite membrane concentrator, followed by flotation or decanting (20), removal of flotation sludge or decanted sludge for a sludge deposit (67), disinfection (26) of treated water and passage of the water already treated and disinfected to the excavated artificial beach (1).

4. The process of implementation of artificial water beach recreational chain according to claim 3, characterized by installation, in the continuous and flexible linear treatment channel (3), of at least one septum (4), laid down centrally or decentralised in accordance with in relation to the continuous and flexible linear treatment channel (3), and the at least one septum (4) is mounted along an internal area of the continuous and flexible linear treatment channel (3), in order to make up the parallel subchannels (24), the parallel subchannels (24) being at least two parallel linear subchannels that can be used individually.

5. The process of implementation of artificial water beach recreational chain according to claim 4, characterized by installation, at an entrance of each parallel subchannel (24), of independent floodgates (25), for individualized flow control and individual use of each parallel subchannel (24).

6. The process of implementation of artificial water beach recreational chain according to claim 1, characterized by the disinfection of the water (6) of the excavated artificial beach (1) being upgraded by means of chlorine water and air injections, through aerators of (27) at various points in the bottom (13) of the excavated artificial beach (1), promoting oxidation, resuspension and flotation of the decanted dirt inside the excavated artificial beach (1).

7. The process of implementation of artificial water beach recreational chain according to claim 1, characterized by the disinfection of the water (6) from the excavated artificial beach (1) to be complemented by injection, through injectors (50) of jets of water and air with chlorine, at various points along an edge (29) of the excavated artificial beach (1), providing oxidation of pollutants and targeting of resuspended pollution on the surface of the water (6) from the excavated artificial beach (1) to the exit (30) point of the excavated artificial beach (1).

8. The process of implementation of artificial water beach recreational chain according to claim 1, characterized by the water being used for a permanent disinfection system, through analysing (27) and by injection, by means of edge injectors (50), (29), water and air jets, being captured (51) downstream of the continuous and flexible linear treatment channel (3) by flotation or decanting (20) and upstream of the excavated artificial beach (1).

9. The process of implementation of artificial water beach recreational chain according to claim 1, characterized by resuspended pollution existing on the surface of water (6) of the excavated artificial beach (1), being directed to the exit (30) point of the excavated artificial beach (1), through the existing (50) water and air injectors along the edge (29) of the aforementioned excavated artificial beach (1), being that the resuspended pollution, existing on the surface of water (6) excavated artificial beach (1), is captured through the wheel of floating and stationary dredging (31), installed in a vicinity of the exit (30) point of the excavated artificial beach (1).

10. The process of implementation of artificial beach of running water for recreation according to claim 1, characterized by installation of a floating scraper system (32), before the wheel of floating and stationary dredging (31), to assist in directing resuspended pollution existing in the surface of water (6) from the excavated artificial beach (1), to the wheel of floating and stationary dredging (31), which is installed in the a vicinity of the exit (30) point of the excavated artificial beach (1).

11. The process of implementation of artificial beach of running water for recreation according to claim 1, characterized by tinstallation of a cistern (33), at the exit (30) point of the excavated artificial beach (1) and after the wheel of floating and stationary dredging (31), for retention of sand from the excavated artificial beach (1) and providing evaporation of existing residual chlorine in the water (6) of the excavated artificial beach (1).

12. The process of implementation of artificial beach of running water for recreation according to claim 1, characterized by water (6) from the excavated artificial beach (1), after passage through a cistern (33), being returned to the external water body (2), devoid of chlorine, sand or suspended solids.

13. The process of implementation of artificial beach of running water for recreation according to claim 1, characterized by, in an entrance of the excavated artificial beach (1), installing of a small lake (39), and the waterproofing (14) of the bottom (13) of the small lake (39), and adding the waterproofing and the natural sand (10), together with sand plastic, or phosphorescent resin (5), and capturing the water (41) used in the small lake (39) at the continuous and flexible linear treatment channel (3) by the flotation or decanting system (20), after treatment and disinfection (26), with permanent disinfection of water being provided for (41) the small lake (39), by means of water and air injections with chlorine, through the bottom aerators (55) at the various points in the bottom (13) waterproofed (14) and covered with the natural sand (10) and through the injectors (56), installed at the various points throughout the edge (57) of the small lake (39), and in a vicinity of the exit point (58) of the small lake (39), a floating scraper system (44) and a floating and stationary dredging wheel (43) are installed, for dredging pollution resuspended on the surface of the water (41) of the small lake (39), and at the exit point (58) from the small lake (39) and after the floating and stationary dredging wheel (43) a cistern (42) is provided and water (41) originates in the small lake (39) after passing through the cistern (42), is transported (60) and discharged directly into the cistern (33) at the exit (30) of the excavated artificial beach (1), not mixing with treated water for filling (38) the excavated artificial beach (1).

14. The process of implementation of artificial beach of running water for recreation according to claim 13, characterised by installing, under the waterproofing (14) with a vinyl or plastic blanket, to both the excavated artificial beach (1) and the small lake (39) of a system of metal tips or plastic tips (15), which are connected to the pumps (52) for suction of water and gases, providing a lowering of the water table (16), so as to ensure that there are no deformations and damage to the waterproofing (14) bottom (13), depending on neutral pressure of the water table (16), water from the water table (16), captured by the system of metal tips or plastic tips (15), being transported (40) to a vicinity of the continuous and flexible linear treatment channel (3), mixing water from the external water body (2), to treatment and use for filling the excavated artificial beach (1) and the small lake (39).

15. The process of implementation of artificial beach of running water for recreation according to the claim 13, characterized by resuspended pollution, existing in the water (6) of the excavated artificial beach (1) and removed by the wheel of floating and stationary dredging (31), and the resuspended pollution, existing in water (41), of the small lake (39), removed by the floating and stationary dredging wheel (43), being transported (34) to a sludge deposit (67) from the continuous and flexible linear treatment channel (3), for removal.

* * * * *